US011874087B1

(12) United States Patent
Burnsed, Jr.

(10) Patent No.: US 11,874,087 B1
(45) Date of Patent: Jan. 16, 2024

(54) SLING ATTACHMENT DEVICE

(71) Applicant: Blue Force Gear, Inc., Pooler, GA (US)

(72) Inventor: Ashley A. Burnsed, Jr., Port Wentworth, GA (US)

(73) Assignee: BLUE FORCE GEAR, INC., Pooler, GA (US)

( * ) Notice: Subject to any disclaimer, the term of this patent is extended or adjusted under 35 U.S.C. 154(b) by 0 days.

(21) Appl. No.: 16/921,135

(22) Filed: Jul. 6, 2020

Related U.S. Application Data

(63) Continuation of application No. 16/362,661, filed on Mar. 24, 2019, now abandoned, which is a continuation of application No. 15/700,974, filed on Sep. 11, 2017, now Pat. No. 10,281,234, which is a continuation of application No. 15/387,952, filed on Dec. 22, 2016, now Pat. No. 9,791,237, which is a continuation of application No. 14/935,747, filed on Nov. 9, 2015, now Pat. No. 9,528,795.

(60) Provisional application No. 62/077,260, filed on Nov. 9, 2014.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01); *Y10S 224/913* (2013.01); *Y10T 24/12* (2015.01)

(58) Field of Classification Search
CPC ... Y10T 24/3913; Y10T 24/141; Y10T 24/12; F41C 23/02; F41C 33/002; Y10S 224/913
USPC ..... 224/150; 42/85
See application file for complete search history.

(56) References Cited

U.S. PATENT DOCUMENTS 1,079,098 A * 11/1913 Beckert ..... F16G 11/00 24/128
1,323,701 A * 12/1919 Lethern ..... F41C 33/002 224/150
1,523,888 A * 1/1925 Gladstone ..... B65D 63/14 24/28
2,440,012 A * 4/1948 Haver ..... G09F 3/0352 24/30.5 R
2,579,689 A * 12/1951 Miller ..... B65D 63/14 24/30.5 R (Continued)

OTHER PUBLICATIONS

Blue Force Gear, Inc., Universal Wire Loop, https://www.blueforcegear.com/universal-wire-loop-uwl-3-25.html, 1 accessed Nov. 2, 2015.

*Primary Examiner* — Justin M Larson
(74) *Attorney, Agent, or Firm* — Bennet K. Langlotz; Langlotz Patent & Trademark Works, LLC

(57) ABSTRACT

A sling attachment device has a body having a strap facility adapted for attachment of a sling strap, a flexible elongated tether having a first end attached to the body, the tether having a free end opposite the first end, and the body defining a receptacle operable to receive the free end of the tether, such that the tether may be threaded through an aperture on a rifle and received by the receptacle to secure the strap to the rifle. The tether may have a selected first width along at least a portion of its length, and the free end may have a second width greater than the first width. A ball may be attached to the free end. The body may define a channel having a width larger than the first width and smaller than the second width. There may be an aperture adjacent to the channel.

1 Claim, 10 Drawing Sheets

(56) References Cited

U.S. PATENT DOCUMENTS 3,027,130 A * 3/1962 Stumpff ..... B68C 1/20 248/309.1
3,335,468 A * 8/1967 Frank ..... F16G 11/10 24/115 R
3,861,070 A * 1/1975 Wild ..... F41C 23/16 42/85
4,057,180 A * 11/1977 Whittaker ..... B60R 7/14 224/282
4,505,012 A * 3/1985 Johnson ..... F41C 23/02 224/150
4,610,476 A * 9/1986 Keiner ..... A44B 11/06 294/149
4,823,998 A * 4/1989 Johnson ..... F41C 23/02 224/150
4,982,522 A * 1/1991 Norton ..... F41C 33/00 224/220
4,991,265 A * 2/1991 Campbell ..... B65D 63/1027 24/128
5,062,184 A * 11/1991 Rowland ..... B65H 75/366 24/16 PB
5,093,964 A * 3/1992 Rowland ..... B65H 75/366 24/16 PB
5,246,154 A * 9/1993 Adams ..... A45F 3/14 224/150
5,305,540 A * 4/1994 Blenk ..... F41C 23/02 224/150
5,326,134 A * 7/1994 Hiser ..... A63C 11/222 24/17 AP
5,542,462 A * 8/1996 Elsenheimer ..... E06B 9/326 16/442
5,718,075 A * 2/1998 Johnson ..... F41C 23/02 224/150
5,868,293 A * 2/1999 D'Addario ..... A44B 11/266 224/250
6,192,559 B1 * 2/2001 Munsell, Jr. ..... A43C 7/00 24/128
6,536,154 B1 * 3/2003 Norris ..... A44B 11/006 24/2.5
6,749,099 B2 * 6/2004 Danielson ..... A45F 5/02 224/250
6,761,294 B2 * 7/2004 Gann ..... F41C 23/02 224/150
7,219,398 B1 * 5/2007 Hunt ..... F16G 11/00 24/115 R
7,669,299 B2 * 3/2010 McAnelly ..... G10G 5/005 224/257
7,828,180 B2 * 11/2010 Slesar ..... A45F 5/02 119/776
7,866,081 B2 * 1/2011 Seuk ..... F41A 23/16 24/128
8,516,732 B2 * 8/2013 Burnsed, Jr. ..... F41C 23/02 24/573.11
8,793,916 B2 * 8/2014 Rogers ..... F41C 23/02 24/2.5
9,157,700 B1 * 10/2015 Hansen ..... F41C 33/002
9,528,795 B1 * 12/2016 Burnsed, Jr. ..... F41C 33/002
9,791,237 B1 * 10/2017 Burnsed, Jr. ..... F41C 33/002
10,281,234 B1 * 5/2019 Burnsed, Jr. ..... F41C 23/02
2013/0333168 A1 12/2013 Burnsed, Jr.
2015/0128469 A1 * 5/2015 Mossie ..... F41C 23/02 42/90
2016/0084613 A1 * 3/2016 Biggs ..... F41C 33/002 224/150

* cited by examiner

SLING ATTACHMENT DEVICE

CROSS-REFERENCE TO RELATED APPLICATION

This is a Continuation of U.S. patent application Ser. No. 16/362,661, entitled "SLING ATTACHMENT DEVICE," filed Mar. 24, 2019, which is a Continuation of U.S. patent application Ser. No. 15/700,974, now issued as U.S. Pat. No. 10,281,234, entitled "SLING ATTACHMENT DEVICE," filed Sep. 11, 2017, which is a Continuation of U.S. patent application Ser. No. 15/387,952, now issued as U.S. Pat. No. 9,791,237, entitled "SLING ATTACHMENT DEVICE," filed Dec. 22, 2016, which is a Continuation of U.S. patent application Ser. No. 14/935,747, now issued as U.S. Pat. No. 9,528,795, entitled "SLING ATTACHMENT DEVICE," filed Nov. 9, 2015, which claims the benefit of U.S. Provisional Patent Application No. 62/077,260, entitled "SLING ATTACHMENT DEVICE," filed on Nov. 9, 2014 which are hereby incorporated by reference in their entirety for all that is taught and disclosed therein.

FIELD OF THE INVENTION

The present invention relates to firearms, and more particularly to a sling attachment device that enables a sling to be easily and quickly removed from a firearm without first detaching the sling from the sling attachment device.

BACKGROUND OF THE INVENTION

Weapon slings provide many advantages to the user when they are installed on a firearm, such as a rifle or machine gun. First, slings are helpful for carrying a firearm by freeing the user's hands and distributing the firearm's weight more uniformly over the user's body to reduce fatigue. Second, slings can serve as an effective shooting support. Two-point slings have attachment points at both the front and rear of the firearm. These are particularly helpful for facilitating accurate shooting from a variety of positions, including shooting using only one hand, by steadying the attached firearm.

Unfortunately, attaching a weapon sling to some firearms can be difficult because the manufacturer did not make allowances for doing so when they made the gun. Therefore, it takes special devices to adapt the sling to mount to the gun.

The use of a sling loop body with a permanently attached loop of nylon coated stainless steel aircraft grade cable to connect a weapon sling to a firearm is well known in the art. The cable can be inserted through eyelets, loops, slots, or any other opening on the firearm the cable can fit through. The body is then passed through the loop of the cable to form a lark's head knot. Subsequently, one end of a sling is attached to the sling loop body by passing the end of the sling through a slot in the sling loop body and securing the end of the sling to itself using a buckle.

The nylon coated cable is successful in achieving its primary objectives in that it is quieter, stronger, and more versatile than traditional sling hook attachments. The nylon coated cable also does not create wear marks on the firearm. The disadvantage of the use of a loop of cable permanently attached to the sling loop body is that the sling must first be detached from the sling loop body during both installation and removal of the sling loop body on the firearm. This requirement makes it impossible to easily and quickly remove the sling from the firearm, which impedes conversion of a sling from a two-point carry position to a single-point carry position for dynamic situations or confined spaces. The inability to easily and quickly remove the sling from the firearm could also be potentially dangerous if the sling were to become entangled with the user or the environment in a combat or law enforcement situation.

Therefore, a need exists for a new and improved sling attachment device that enables a sling to be easily and quickly removed from a firearm without first detaching the sling from the sling attachment device. In this regard, the various embodiments of the present invention substantially fulfill at least some of these needs. In this respect, the sling attachment device according to the present invention substantially departs from the conventional concepts and designs of the prior art, and in doing so provides an apparatus primarily developed for the purpose of enabling a sling to be easily and quickly removed from a firearm without first detaching the sling from the sling attachment device.

SUMMARY OF THE INVENTION

The present invention provides an improved sling attachment device, and overcomes the above-mentioned disadvantages and drawbacks of the prior art. As such, the general purpose of the present invention, which will be described subsequently in greater detail, is to provide an improved sling attachment device that has all the advantages of the prior art mentioned above.

To attain this, the preferred embodiment of the present invention essentially comprises a body having a strap facility adapted for attachment of a sling strap, a flexible elongated tether having a first end attached to the body, the tether having a free end opposite the first end, and the body defining a receptacle operable to receive the free end of the tether, such that the tether may be threaded through an aperture on a rifle and received by the receptacle to secure the strap to the rifle. The tether may have a selected first width along at least a portion of its length, and the free end may have a second width greater than the first width. A ball may be attached to the free end. The body may define a channel having a width larger than the first width and smaller than the second width. There may be an aperture adjacent to the channel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
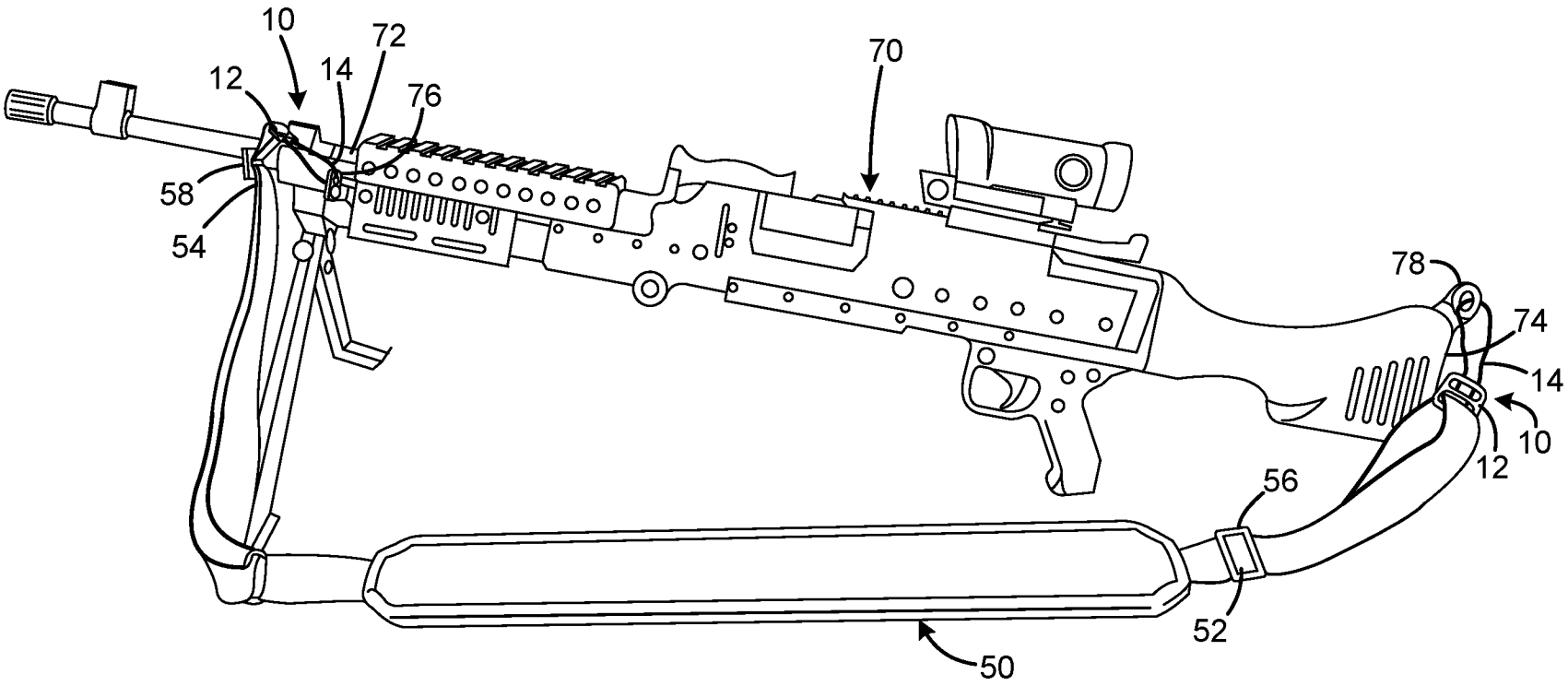
FIG. 1 is a side perspective view of the current embodiment of a sling attachment device constructed in accordance with the principles of the present invention in use attached to a rifle.

An embodiment of the sling attachment device of the present invention is shown and generally designated by the reference numeral 10.

FIG. 1 illustrates the improved sling attachment device 10 of the present invention. More particularly, FIG. 1 shows two sling attachment devices in use attaching a sling strap 50 to a rifle 70. Each sling attachment device has a body 12 with a sling strap slot 16. Each opposed end 52, 54 of the sling strap is inserted through a sling strap slot and is releasably secured to the sling strap by a buckle 56, 58. Each sling attachment device also has a tether in the form of a cable loop 14 having a secured end 32 and a free end 34. When the cable loop is in the open position, the free end can be inserted through an eyelet 76, 78 located at the front 72 and rear 74 of the rifle. The free ends are then releasably attached to the body in the closed position in a manner that will be described in more detail in the description of FIGS. 2-4. Because the cable loop can be positioned in both the open and closed positions while an end of the sling strap is attached to the body, the sling strap can be easily and quickly removed from the rifle without first detaching the sling strap from the body.

Figure 2:
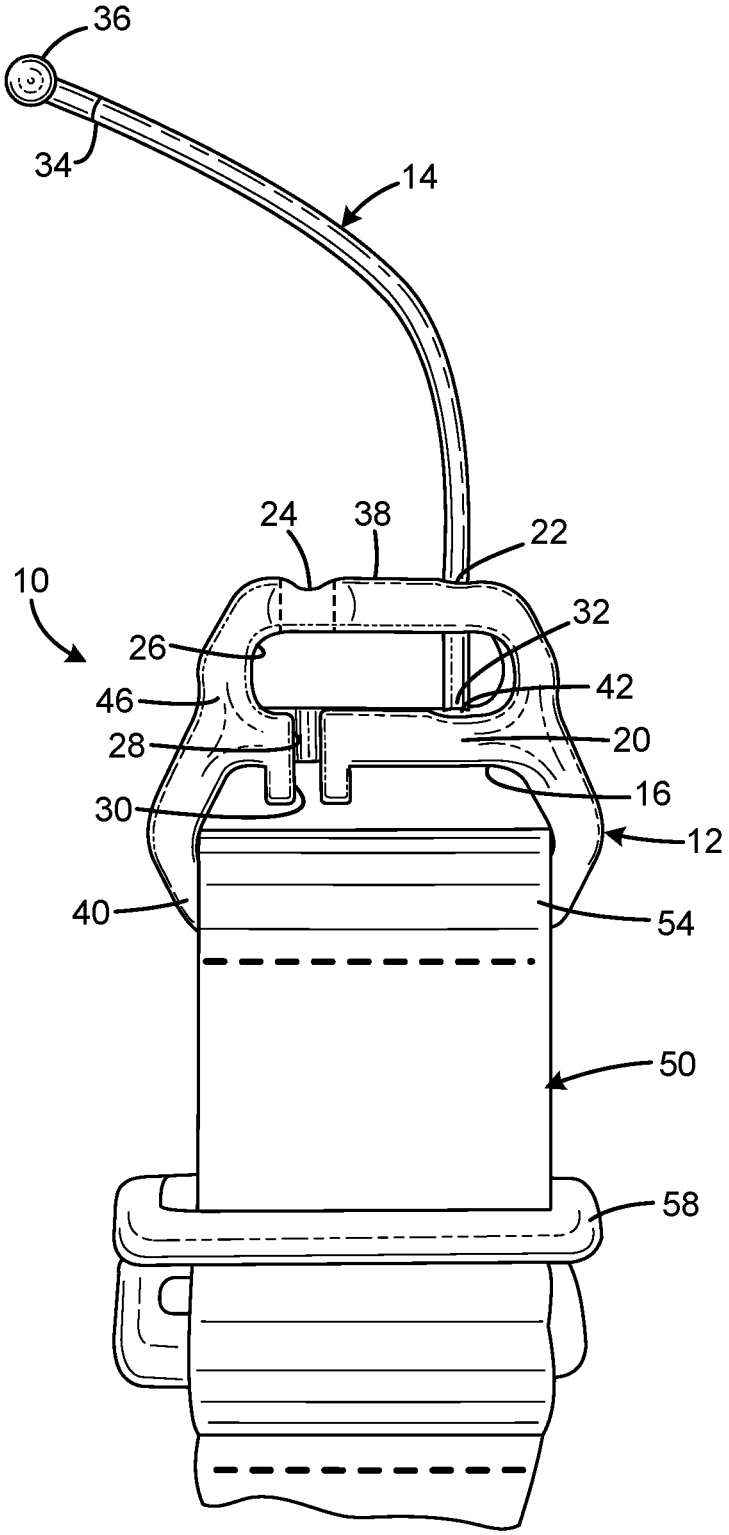
FIG. 2 is a top view of the sling attachment device of FIG. 1 detached from the rifle with the cable loop in the open position.

FIGS. 2-8 illustrate the improved sling attachment device 10 of the present invention. More particularly, FIG. 2 shows a sling attachment device with the cable loop 14 in the open position. The body 12 is generally trapezoidal with a top 46, a bottom 48, and two wide slots (sling strap slot 16 and cable slot 26) at the front 38 and rear 40. The wide slots are separated by a bar 20. One end 54 of the sling strap 50 can be threaded through the sling strap slot 16 at the wider rear of the body and releasably secured to the sling strap using buckle 58.

At the narrower front end 38 of the body 12 there are two small apertures 22, 24 that communicate with the cable slot 26. The bar 20 has a small aperture 42 that communicates with the sling strap slot 16 and the cable slot 26 and is axially registered with the aperture 22. Aperture 22 has the cable loop 14 running through it with the secured end 32 of the cable also passing through aperture 42. The secured end of the cable is permanently attached to the bar because it is enlarged to such an extent that the secured end cannot be withdrawn from aperture 42.

The free end 34 of the cable loop 14 has a ball shank 36 attached to it to widen the free end of the cable loop. The aperture 24 is sized to permit free passage of the free end of the cable. The bar 20 defines a ball slot 28 and ball socket 30 that are axially registered with the aperture 24. The ball slot does not completely penetrate the bar, and the ball socket protrudes rearwardly from the bar and closely receives but does not completely encircle the ball shank.

Figure 3:
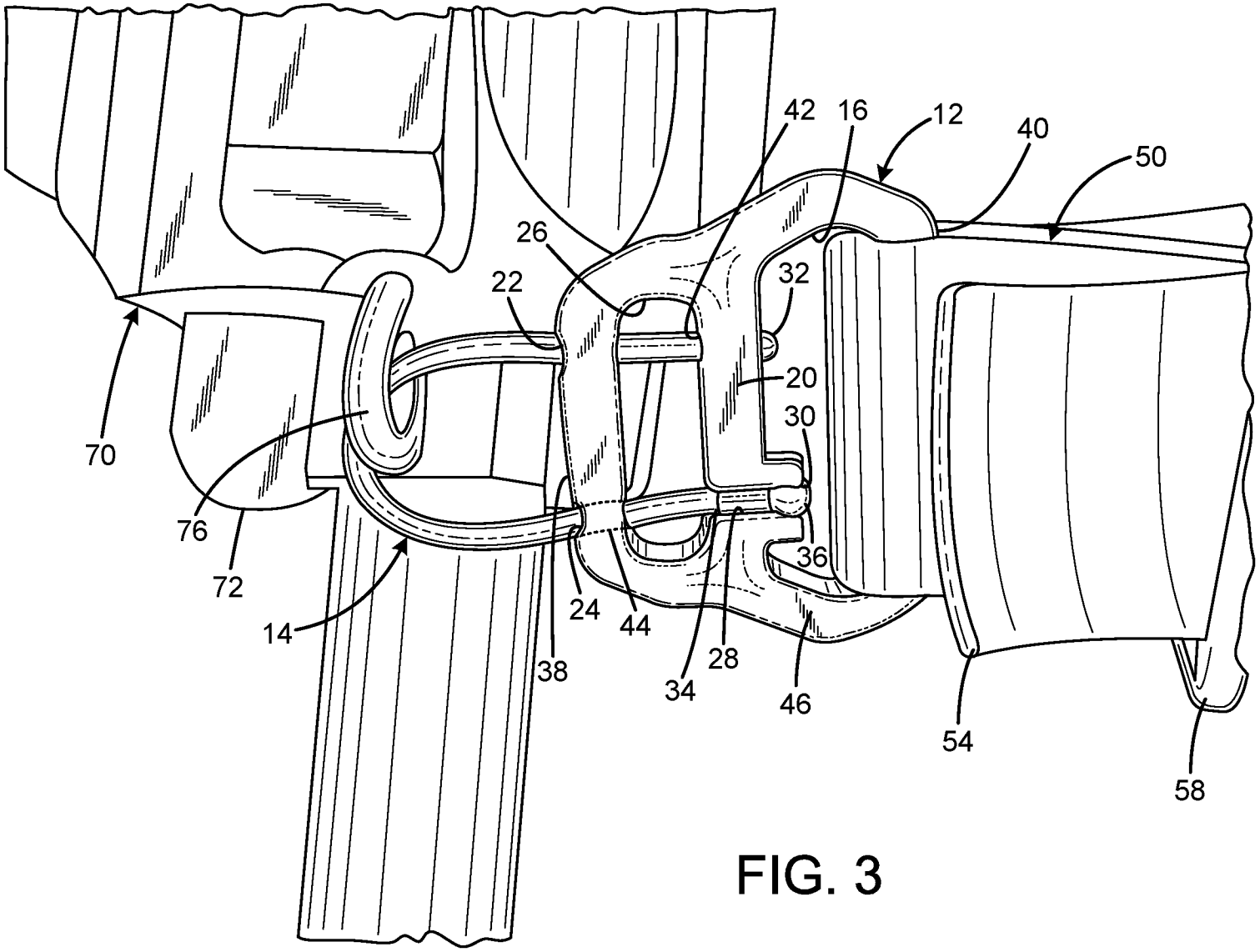
FIG. 3 is a top view of the sling attachment device of FIG. 1 attached to the rifle with the cable loop in the closed position.
Figure 4:
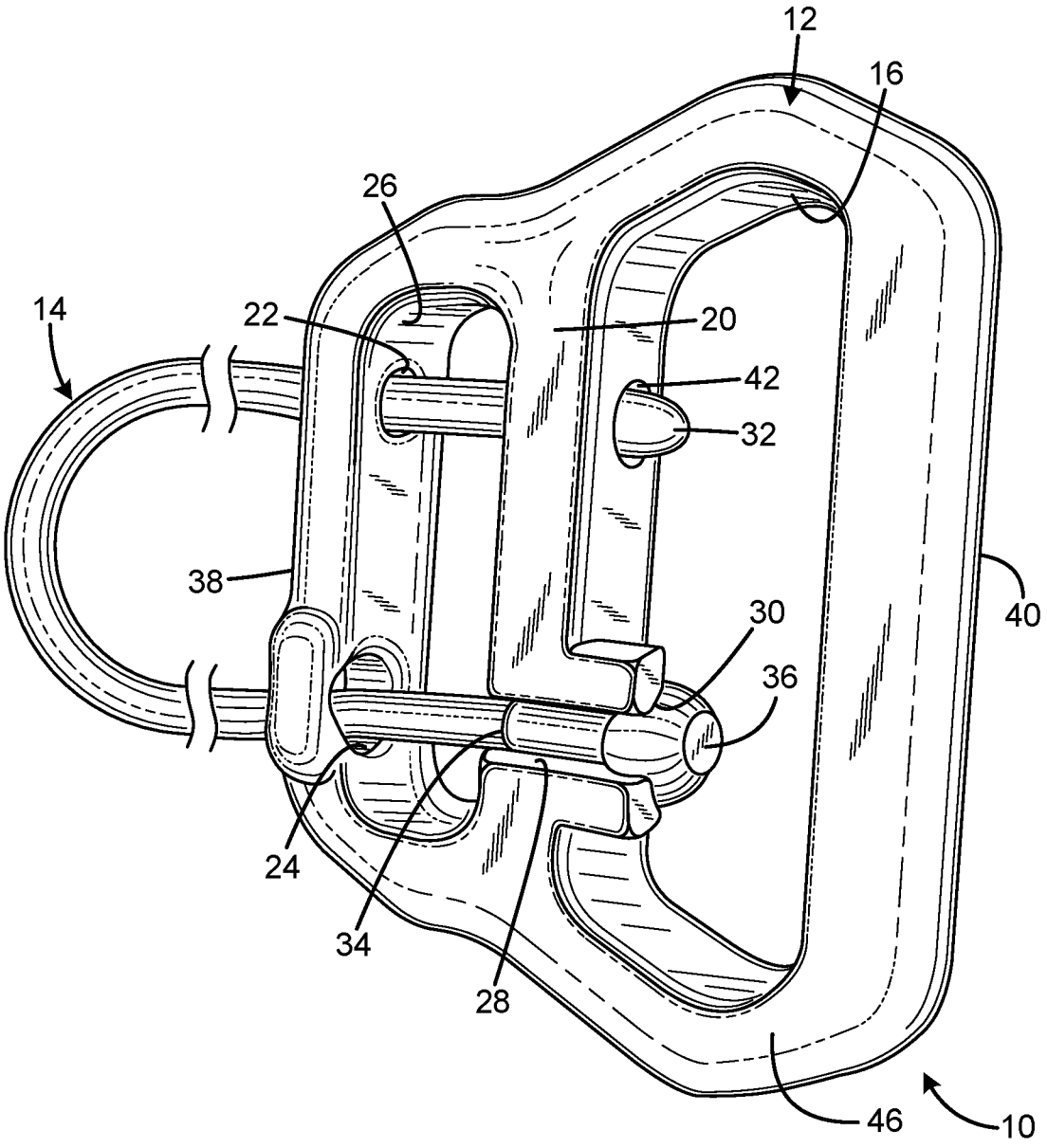
FIG. 4 is a top rear perspective view of the sling attachment device of FIG. 1 detached from the rifle and sling with the cable loop in the closed position.
Figure 5:
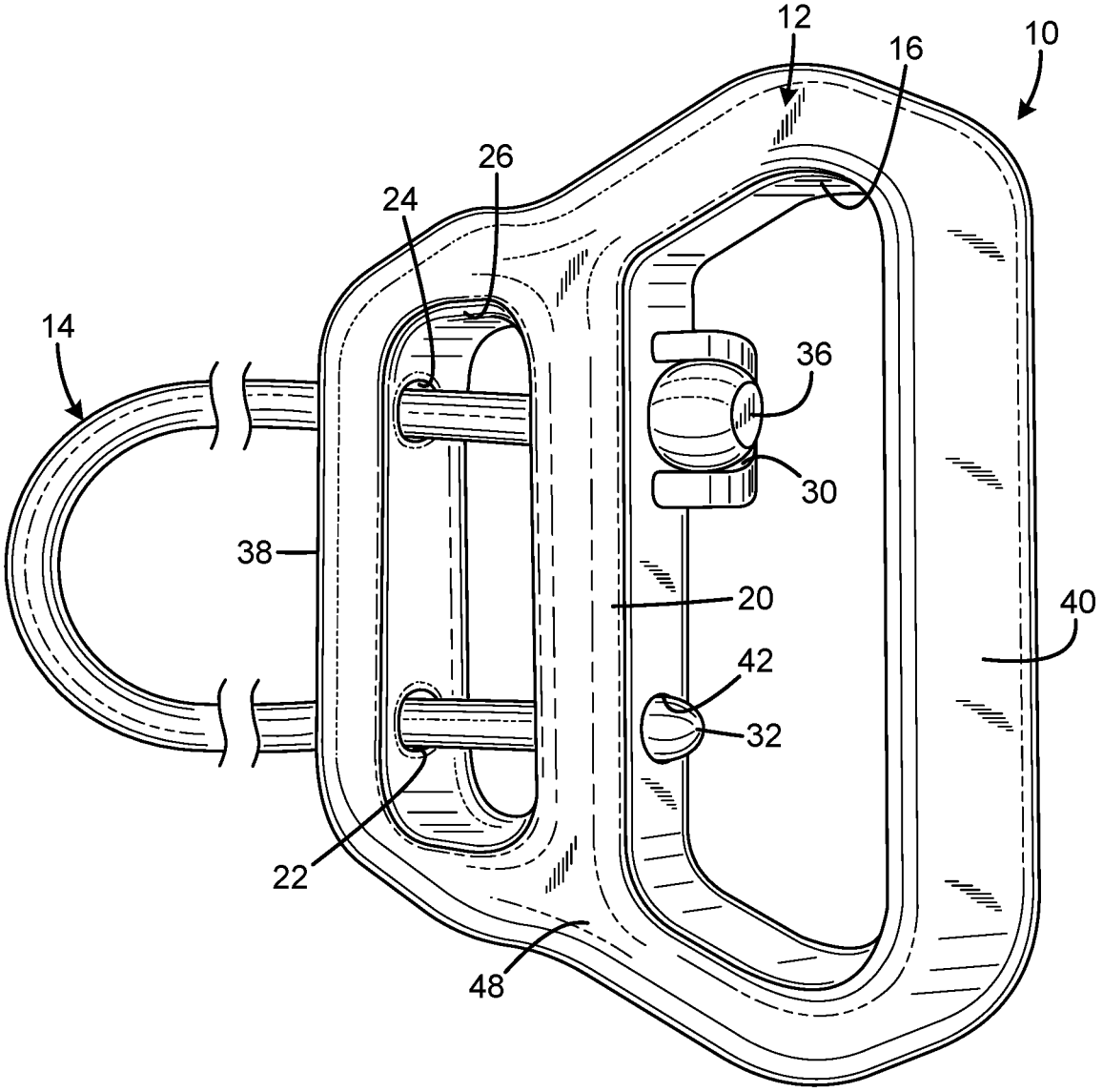
FIG. 5 is a bottom rear perspective view of the sling attachment device of FIG. 1 detached from the rifle and sling with the cable loop in the closed position.
Figure 6:
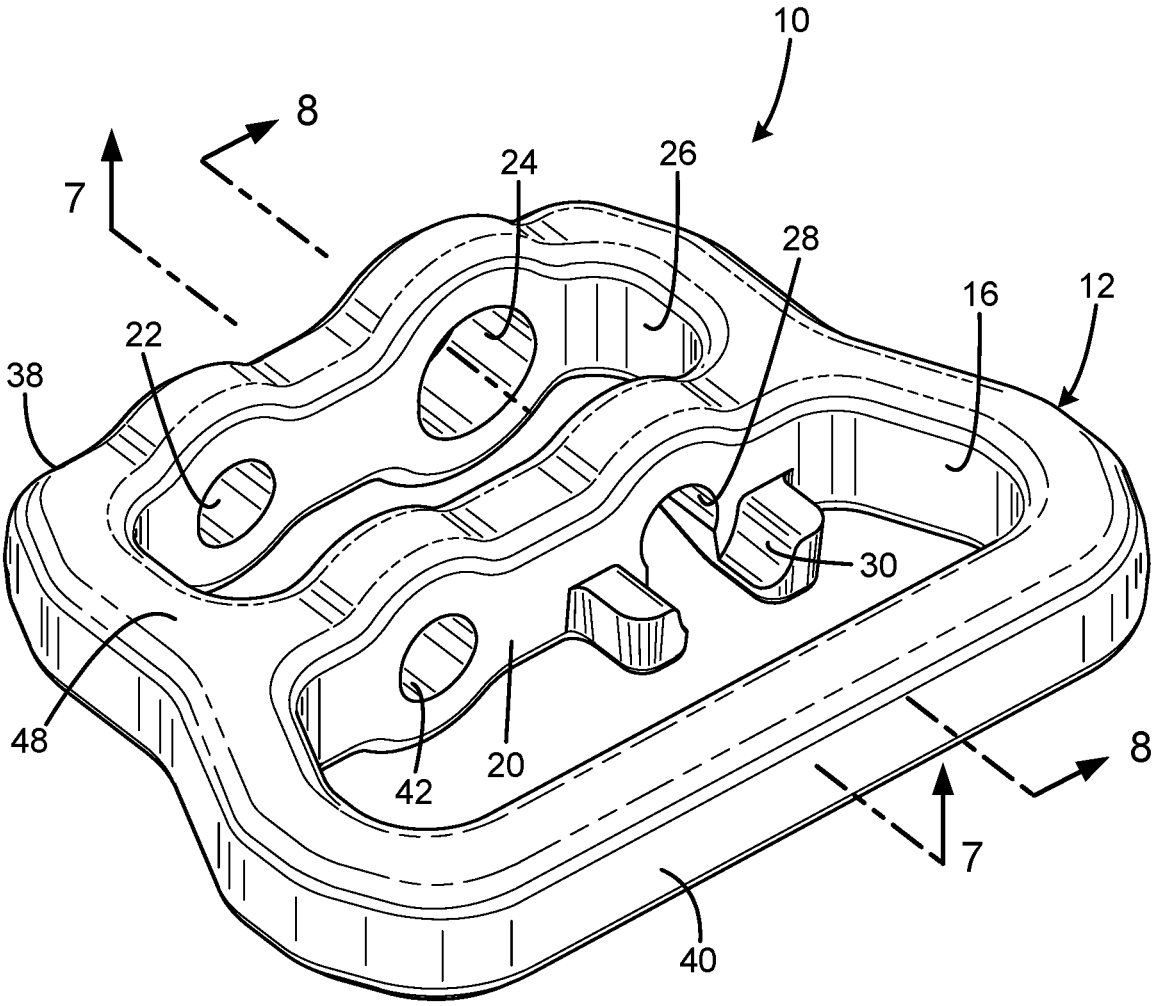
FIG. 6 is a bottom rear perspective view of the body of FIG. 1 detached from the rifle and sling with the cable loop removed.
Figure 7:
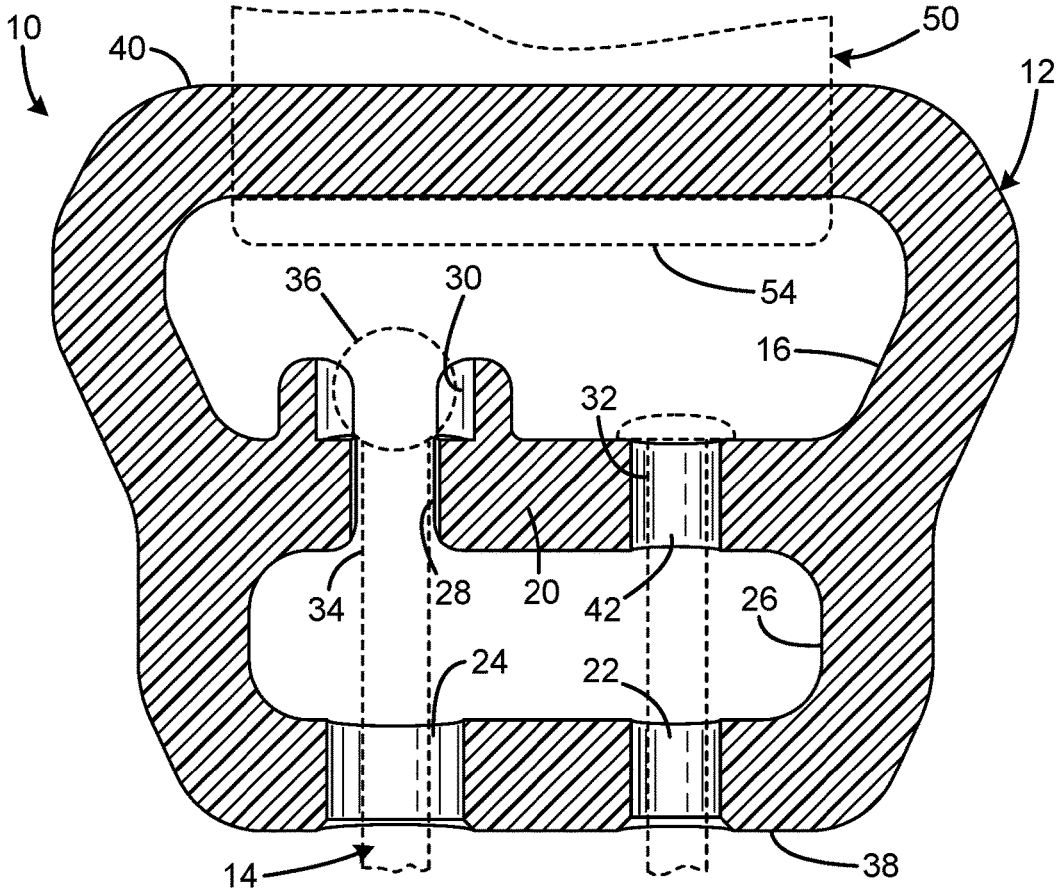
FIG. 7 is a sectional view taken along line 7-7 of FIG. 6.

The free end 34 of the cable loop 14 is made to run through an eyelet 76, 78, loop, slot, or any other opening the free end can fit through on a firearm or anything else a user may wish to attach a sling strap to. As is shown in FIGS. 3 and 4, once the free end is inserted through an eyelet or other opening, the ball shank is pushed through the aperture 24 in the front end 38 of the body 12, up over the ball slot 28 and ball socket 30, and then pulled back to engage the ball shank in the ball socket and ball slot. This action places the cable loop in the closed position where the cable loop is secure and cannot come undone unless the ball shank is pushed up to disengage the ball shank from the ball socket and ball slot. The sling attachment device 10 is now securely attaching the sling strap 50 to the rifle 70.

In the current embodiment, the ball slot is a channel that is wider than the cable loop and narrower than the ball shank. The ball socket is an enlarged portion adapted to closely receive the ball shank. The aperture 24 receives an intermediate portion 44 of the cable loop when the free end of the cable loop is received in the ball socket and ball slot such that lateral displacement of the cable loop does not displace the cable loop from the ball socket and ball slot. The body 12 is a planar member having a rear 40 first edge, and the cable loop is attached to the body at an attachment location defined by aperture 42 to extend in an opposed direction from the first edge and perpendicular to the bar. The ball slot and ball socket form a receptacle that is adjacent to the attachment location.

In the current embodiment, the body 12 is CNC machined from a 6061-T6 aluminum billet before being tumbled and bead-blasted to provide a non-reflective surface. The body is hard-coat anodized before the flexible stainless steel aircraft-grade cable loop 14 with resilient nylon coating is installed with the metal ball shank 36 on the free end 34.

Figure 9:
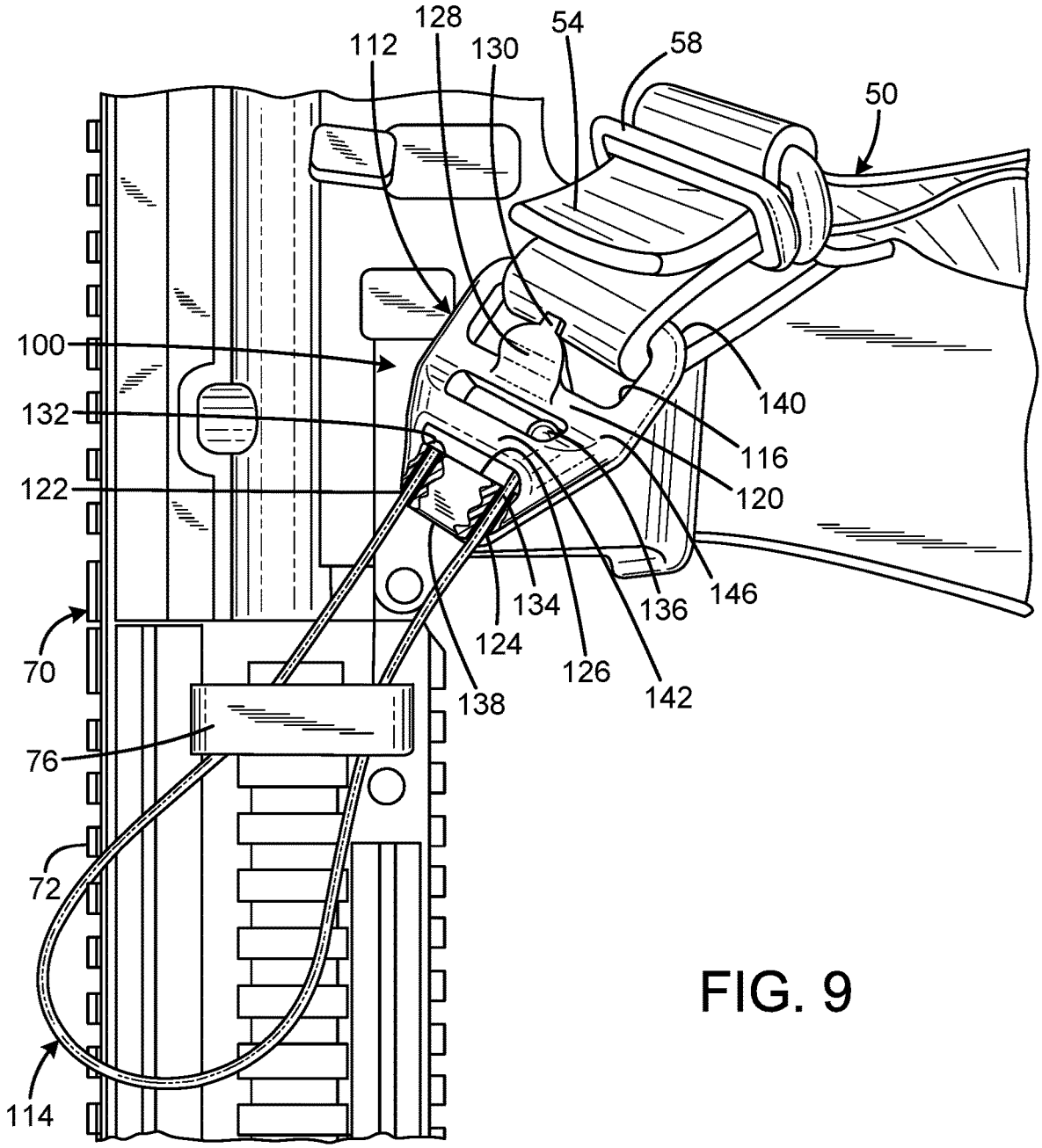
FIG. 9 is a top perspective view of an alternative embodiment of the sling attachment device in the process of being attached to a rifle with the cable loop in the released position.
Figure 10:
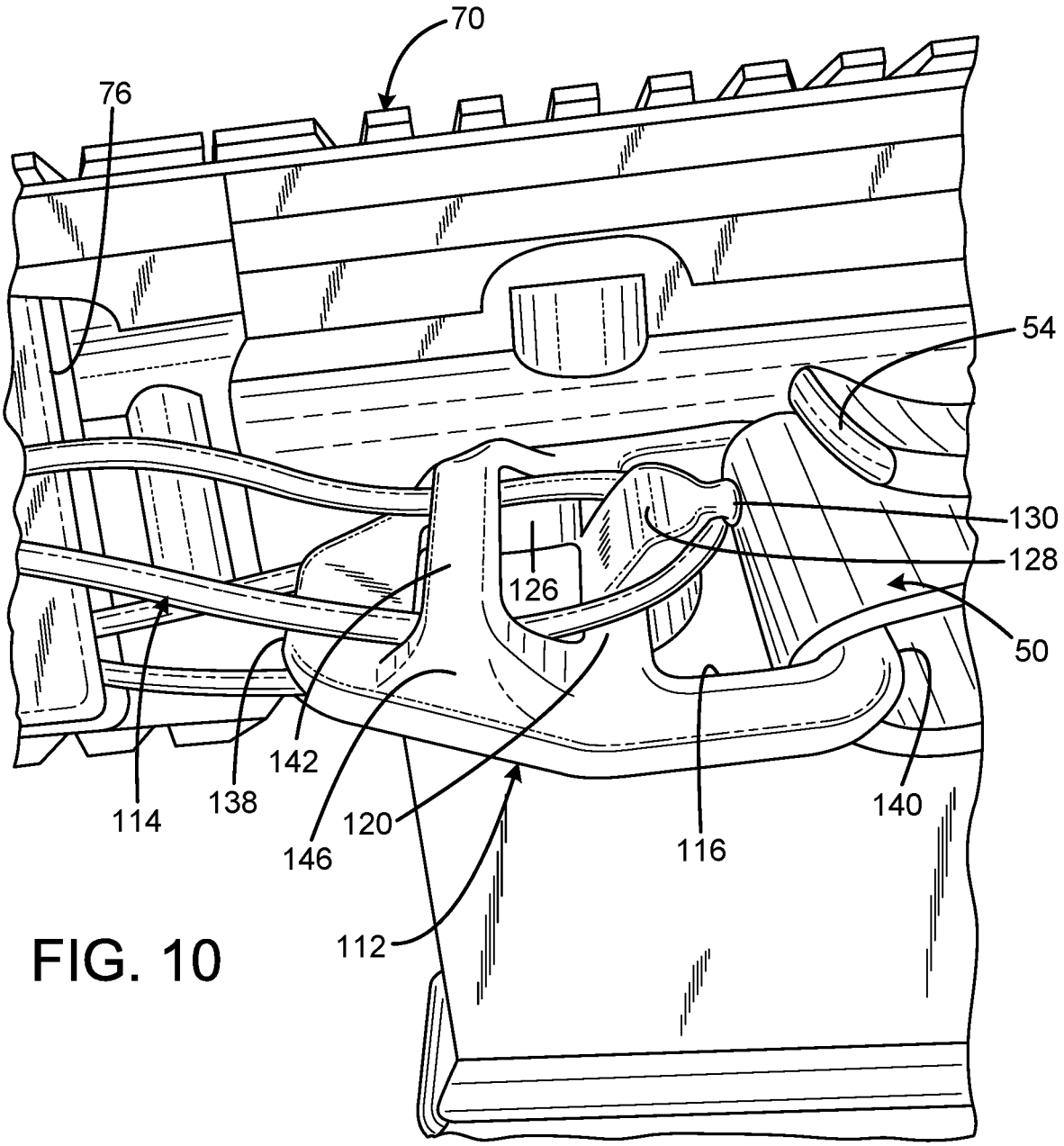
FIG. 10 is a side perspective view of the alternative embodiment of the sling attachment device attached to a rifle with the cable loop in the secured position.
Figure 11:
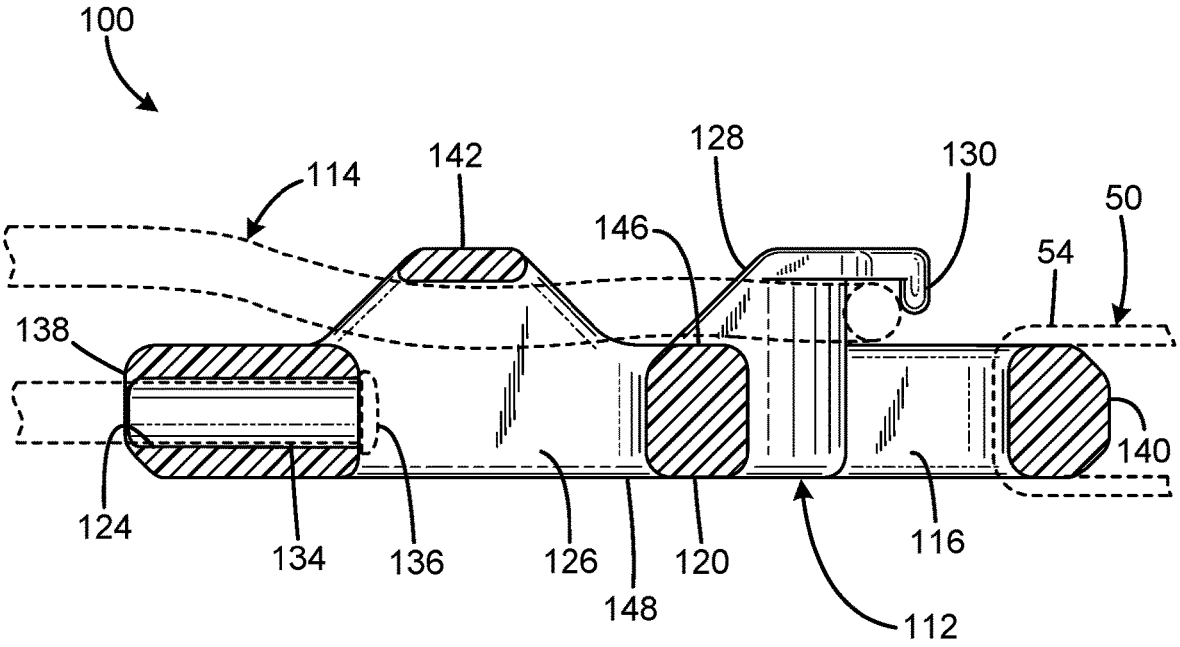
FIG. 11 is a side sectional view of the alternative embodiment of the sling attachment device with the cable loop in the secured position.

FIGS. 9-11 illustrate an alternative embodiment of the improved sling attachment device 100 of the present invention. More particularly, FIG. 9 shows the sling attachment device in the released position, and FIGS. 10 and 11 show the sling attachment device in the secured position. The body 112 is generally trapezoidal with a top 146, a bottom 148, and two wide slots (sling strap slot 116 and cable slot 126) at the front 138 and rear 140. The wide slots are separated by a rear bar 120, which includes an upwardly and rearwardly extending hook 128 with catch 130. A front bar 142 extends across and above the cable slot. One end 54 of a sling strap 50 can be threaded through the sling strap slot 116 at the wider rear of the body and releasably secured to the sling strap using buckle 58.

At the narrower front end 138 of the body 112 there are two small apertures 122, 124 that communicate with the cable slot 126. One end 132 of the cable loop 114 is permanently secured to the body 112 within aperture 122. An opposed end 134 of the cable loop runs through aperture 124. Cable loop end 134 has a ball shank 136 attached to it to widen that end of the cable loop. Cable loop end 134 is permanently attached to the front end 138 of the body because it is enlarged to such an extent by the ball shank that end 134 cannot be withdrawn from aperture 124.

Figure 8:
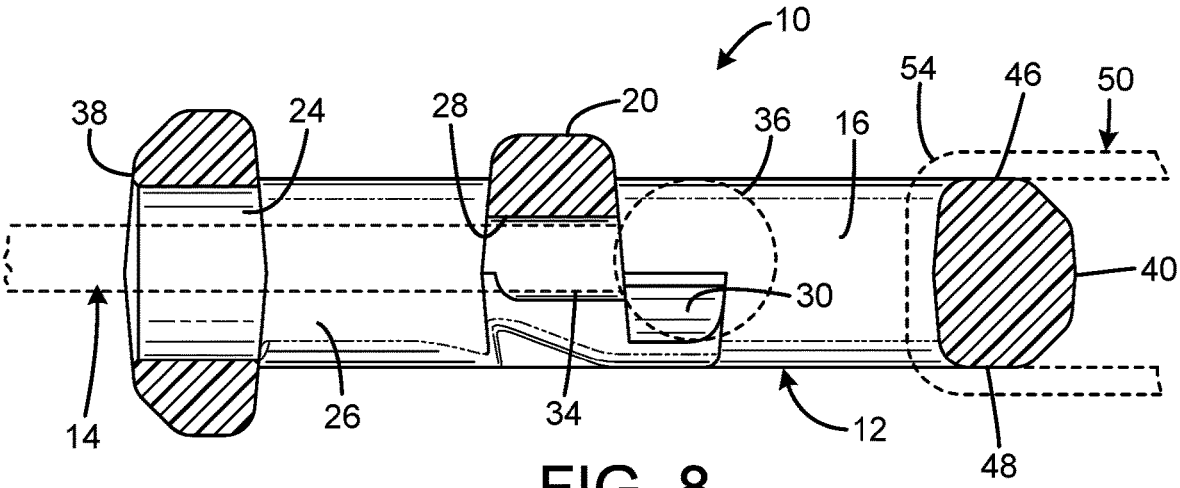
FIG. 8 is a sectional view taken along line 8-8 of FIG. 6.

The cable loop 114 is made to run through an eyelet 76, 78, loop, slot, or any other opening the cable loop can fit through on a firearm or anything else a user may wish to attach a sling strap to. Alternatively, the cable loop can be run around the barrel or butt stock of a firearm. As is shown in FIG. 8, once the cable loop is inserted through an eyelet or other opening, the cable loop is pushed back under the front bar 142 on the body 112 and up the slanted side of the raised hook 128 where the cable loop snaps over the catch 130, which is a tooth-like protrusion. The protrusion holds the cable loop securely, and the front bar ensures lateral displacement of the cable loop does not displace the cable loop from the hook and catch. This action places the cable loop in the secured position where the cable loop is secure and cannot come undone unless the cable loop is pulled rearwardly and subsequently pushed up to disengage the cable loop from the hook and catch. The sling attachment device 100 is now securely attaching the sling strap 50 to the rifle 70.

In the current embodiment, the body 112 is CNC machined from a 6061-T6 aluminum billet before being tumbled and bead-blasted to provide a non-reflective surface. The body is hard-coat anodized before the flexible nylon-coated stainless steel aircraft-grade cable loop 114 is installed with the metal ball shank 136 on the end 134.

While current embodiments of a sling attachment device have been described in detail, it should be apparent that modifications and variations thereto are possible, all of which fall within the true spirit and scope of the invention. For example, the sling attachment device disclosed is also suitable for civilian hunting applications in addition to the disclosed military and law enforcement applications. In addition, although rifles have been disclosed, the sling attachment device is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle sling facility comprising:

a body having a strap facility configured for attachment of a sling strap;

a flexible elongated tether having opposed first and second ends attached to the body, and an intermediate portion connected between the first and second end;

the body having a hook configured to selectably engage a portion of the tether away from the first and second ends; and wherein the second end includes a ball shank;

wherein the first and second ends of the tether are connected to the body.

* * * * *